US008402774B2

(12) United States Patent
Brown

(10) Patent No.: US 8,402,774 B2
(45) Date of Patent: Mar. 26, 2013

(54) SPRAYING WATER UNDER AMBIENT AIR CRYOGENIC VAPORIZERS

(75) Inventor: Ross M. Brown, Escondido, CA (US)

(73) Assignee: Cryoquip, Inc., Murrieta, CA (US)

( * ) Notice: Subject to any disclaimer, the term of this patent is extended or adjusted under 35 U.S.C. 154(b) by 1678 days.

(21) Appl. No.: 11/185,150

(22) Filed: Jul. 21, 2005

(65) Prior Publication Data

US 2007/0017231 A1 Jan. 25, 2007

(51) Int. Cl.
*F17C 9/02* (2006.01)
*F25D 21/00* (2006.01)

(52) U.S. Cl. ..... 62/50.2; 62/272; 62/150; 62/155

(58) Field of Classification Search ..... 62/50.2
See application file for complete search history.

(56) References Cited

U.S. PATENT DOCUMENTS

| | | | | |
|---|---|---|---|---|
| 872,129 | A | | 11/1907 | Heffley |
| 3,124,940 | A | | 3/1964 | Guelton |
| 3,435,623 | A | * | 4/1969 | Tyree, Jr. ..... 62/50.2 |
| 3,633,374 | A | | 1/1972 | Canter |
| 3,735,465 | A | | 5/1973 | Tibbetts et al. |
| 4,133,184 | A | | 1/1979 | Bivins, Jr. |
| 4,271,617 | A | * | 6/1981 | Yoshizawa ..... 37/197 |
| 4,329,842 | A | | 5/1982 | Hoskinson |
| 4,766,736 | A | | 8/1988 | Waldschmidt |
| 5,291,738 | A | | 3/1994 | Waldrop |
| 7,137,623 | B2 | | 11/2006 | Mockry et al. |

* cited by examiner

*Primary Examiner* — John Pettitt

(74) *Attorney, Agent, or Firm* — William W. Haefliger

(57) ABSTRACT

In apparatus to convert cryogenic fluid to gas, a vaporizer having passages to pass the cool or cold cryogenic fluid in heat transfer relation with warming gas flowing downwardly through the vaporizer, the vaporizer having surfaces on which ice collects and from which ice falls to the base of the vaporizer and collects in a pile, and removing fluid flow control means operating to direct flow of removing fluid at the ice pile with sufficient force to cause removal of such ice in the pile relative to the vaporizer base.

4 Claims, 2 Drawing Sheets

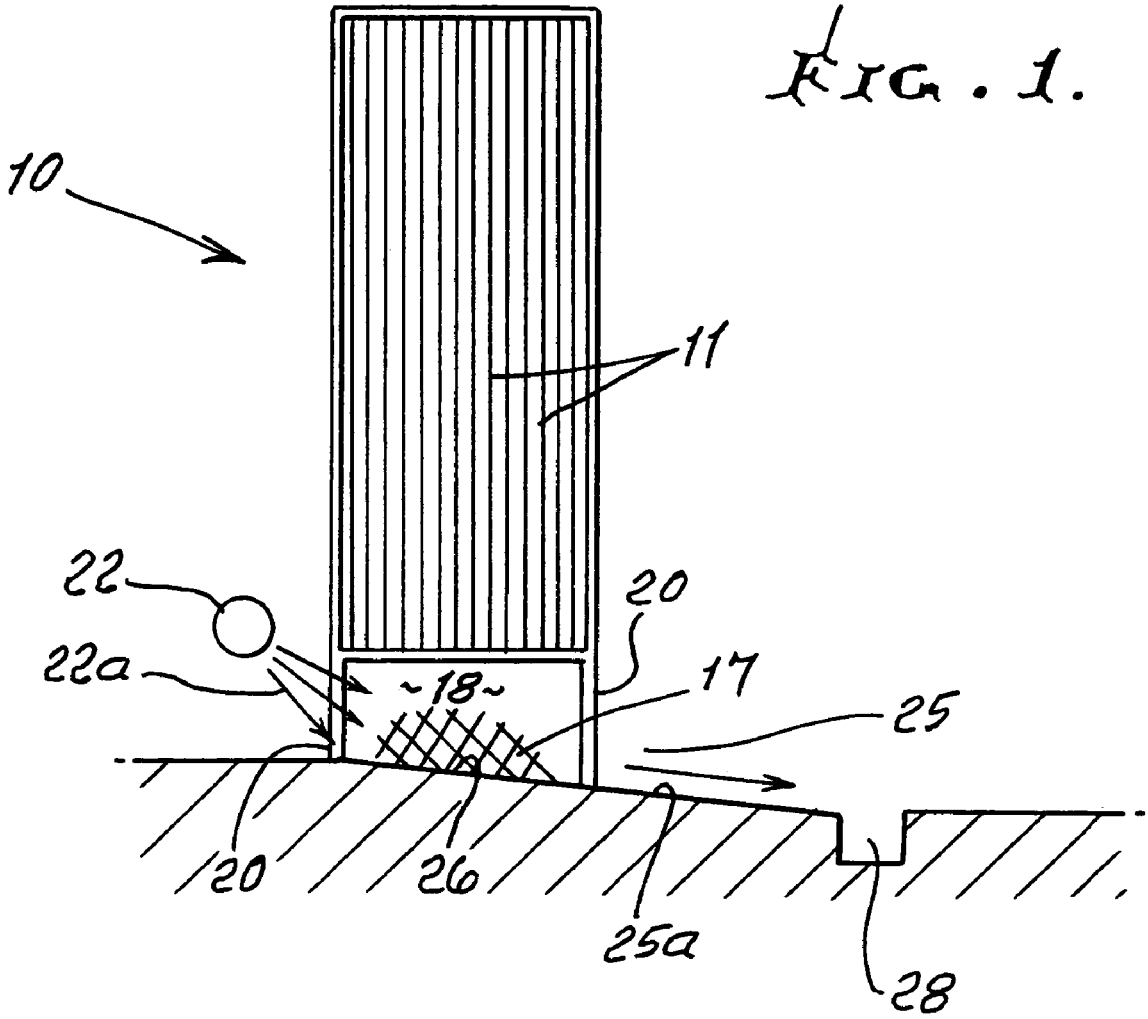
FIG. 1.
FIG. 2.
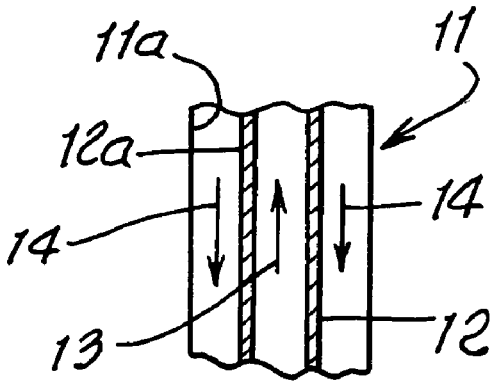

SPRAYING WATER UNDER AMBIENT AIR CRYOGENIC VAPORIZERS

BACKGROUND OF THE INVENTION

This invention relates generally to a method of prolonging operation duration of ambient air heated vaporizers of cryogenic fluids.

Ambient air vaporizers have been used to convert cryogenic liquids into a warm gas for over fifty years. Because of the very cold surfaces inherent in the design of these vaporizers, they all collect frost or ice and are generally limited in the time they can be effective due to the reduction in heat transfer caused by the frozen atmospheric water collecting on the heat transfer surfaces. Operators frequently mitigate this effect by having multiple vaporizers, and alternately switching some units off, allowing them to defrost. Characteristic of these defrosting vaporizers is falling of the frost and ice off the heat transfer surfaces and collection at the base of the unit (the "Pile"). This Pile of frozen water can generally be melted by exposure to warm ambient air during the defrost situation. The Pile also can be removed manually, but this is not practical in large continuously operating installations. As arrays of vaporizers get larger to service big consumers such as steel mills or LNG receiving and send-out terminals, the number of units increase and spacing between units reduces. This precludes sufficient ambient air circulation to melt the pile. Similarly, it is not practical to remove manually the pile with large vaporizer arrays.

SUMMARY OF THE INVENTION

It is a major object of the invention to provide a method for efficiently mechanically removing the accumulated Pile from underneath the vaporizer, to a place where it may be disposed, of readily.

Basically, the improved method includes the steps:

a) providing and operating a vaporizer having passages to pass the cool or cold cryogenic fluid in heat transfer relation with warming gas flowing downwardly through the vaporizer, b) the vaporizer having surfaces on which ice collects and from which ice falls to the base of the vaporizer and collects in a pile, c) and providing and directing a stream of ice removing fluid at the ice pile with sufficient force to cause removal of such ice in the pile relative to the vaporizer base.

A further object includes providing and operating a water jetting device, to jet warm water at the ice pile. For this purpose, the water jet pressure is at least about 50 p.s.i., and the water jet flow is at least 2 cubic inches/second/foot of width.

Yet another object includes discontinuing operation of the vaporizer during ice removal as referred to, and resumed at least 15 minutes after operation of the water jetting device has been discontinued.

A further object includes provision of a sloping base in a space below the vaporizer, for assisting in gravitational flow of ice and cold water, from piles at different sides of the vaporizer.

These and other objects and advantages of the invention, as well as the details of an illustrative embodiment, will be more fully understood from the following specification and drawings, in which:

DRAWING DESCRIPTION

FIG. 1 is a schematic electrical view of preferred apparatus incorporating the invention;

FIG. 2 is an enlarged section taken through a cell in the FIG. 1 apparatus.

DETAILED DESCRIPTION

Figure 3:
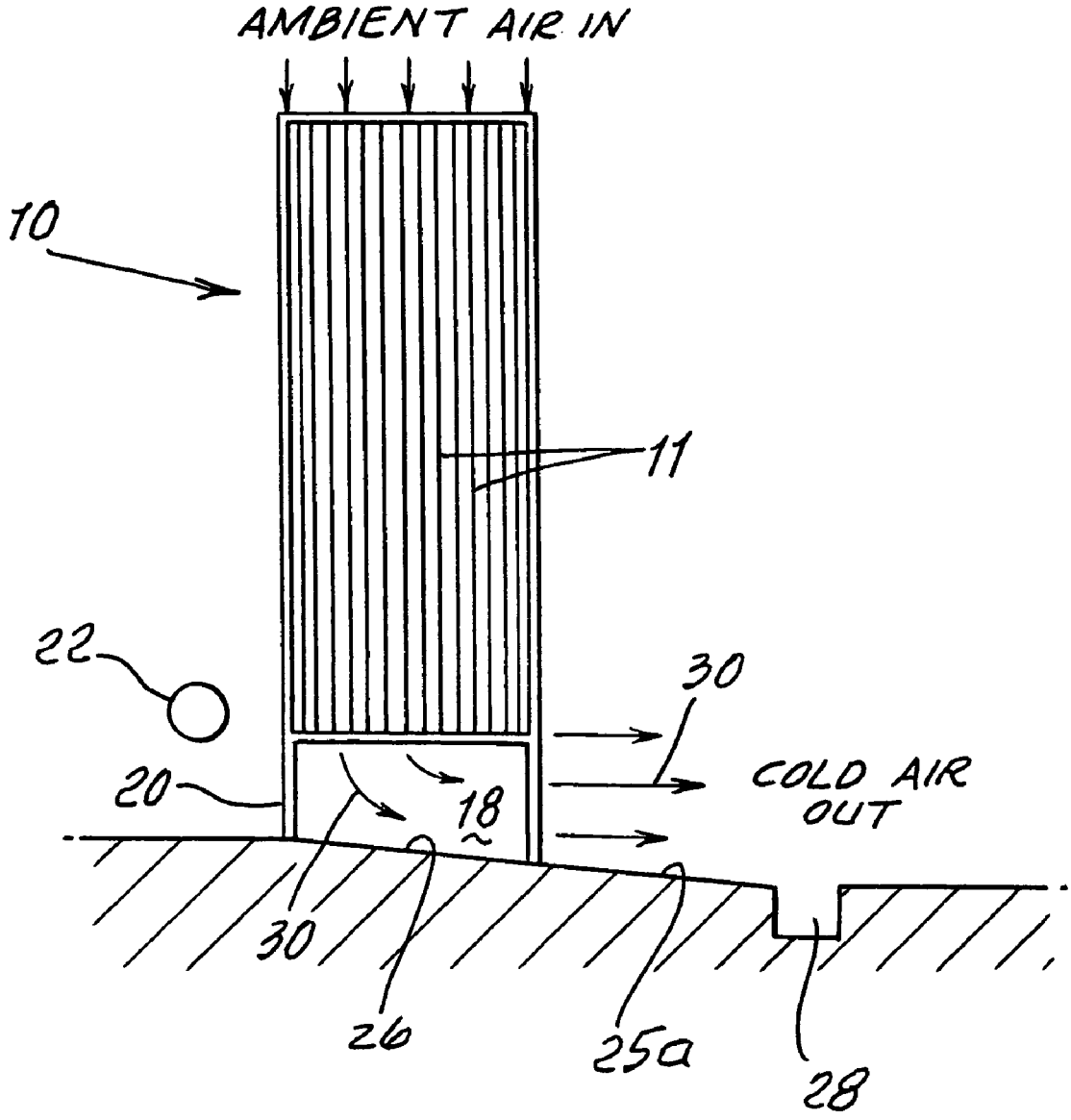
FIG. 3 is a view like FIG. 1, showing another phase of operation.

In FIG. 1, a vaporizer 10 has vertically extending cells 11 for passing ambient air downwardly in warming heat transfer relation with rising cryogenic fluid. FIG. 2 shows a tube 12 in cell 11 for conducting the cryogenic fluid flow 13 upwardly, and ambient air flowing downwardly at 14 in vertical cell passage 11*a*, about the tube. The cryogenic fluid may consist of LNG (liquefied natural gas); and it enter the tubes 12 at their lower ends, as from a supply manifold, and it exits the tubes in gaseous state, to flow in a collection manifold.

The upright vaporizer has surfaces on which ice collects and from which ice falls to the base of the vaporizer, collecting in a pile 17 in a space 18 below the vaporizer to which ambient air from passage 11 also flows. That air exits the space 18 laterally, from beneath the vaporizer, which is supported on legs 20. Such surfaces may include cell surfaces 11*a*, and tube surfaces 12*a*, seen in FIG. 2.

In accordance with the invention, control means is provided to direct flow of (ice pile) removing fluid with sufficient force to cause removal of such ice in the pile laterally relative to the vaporizer base. FIG. 1 shows such control means in the form of a liquid (such as water) jetting device 22 operating to produce a laterally directed spray 22*a* impinging on ice 17 collecting in space 18, and driving the ice laterally and to the exterior 25 from space 18, for disposal.

Preferably, the base surface 26 is sloped below space 18, and at 25*a* at the exterior of the vaporizer, for inducing sliding gravitational translation of ice and jetted water laterally and downwardly toward and into a disposed channel 28. For this purpose, base surface 26 extends openly laterally, beneath the vaporizer. The jetted water lubricates the slide surfaces 26 and 25*a* to assist ice translation movement, for disposal. The basic method includes:

a) providing and operating a vaporizer having passages to pass the cool or cold cryogenic fluid in heat transfer relation with warming gas flowing downwardly through the vaporizer, b) the vaporizer having surfaces on which ice collects and from which ice falls to the base of the vaporizer and collects in a pile, c) and providing and directing a stream of ice removing fluid at the ice pile with sufficient force to cause removal of such ice in the pile relative to the vaporizer base.

Warm water jets are preferably directed at the ice pile to break it up and mechanically convey chunks of the ice/frost to an adjacent area for disposal (usually melting or collection and transport). The water should be slightly heated above freezing to prevent formation of more ice. The warmer the water, the more melting and breakup are achieved. The water jet pressure and flow needs to be sufficient (50 psi or greater just ahead of the nozzle, and at least 2 cubic inches/second/foot of width) to physically move ice chunks away from the vaporizer. The same mechanical effect can be achieved using steam or air jets. The water jets are typically turned off at least 15 minutes prior to placing the vaporizer back in service to permit the vaporizer surfaces to drain and dry so that ice will not be formed from the cold air, whereby the water jets are operated intermittently.

FIG. 3 shows normal operation of the vaporizer, with water jets turned off, and with ambient air 30 flowing downwardly into space 18, and laterally to the exterior, from space 18.

I claim:

1. An apparatus to convert cryogenic fluid to gas, comprising a) a vaporizer having passages to pass the cryogenic fluid in heat transfer relation with warming gas flowing downwardly through the vaporizer, b) the vaporizer having surfaces on which ice collects and from which ice falls to the base of the vaporizer and collects in a pile beneath said passages, c) and removing fluid flow control means operating to direct flow of removing fluid at the ice pile with sufficient fluid force to alone cause removal of all of such ice in the pile relative to and away from the vaporizer base, d) and said cryogenic fluid consisting of LNG, e) said removing fluid being warm water to contact ice in the pile and assist in melting of the ice pile, f) said control means, including a warm water jetting device directed toward a space directly beneath the vaporizer, g) said base sloping to assist in inducing gravitational flow of ice and water including jetted water laterally and downwardly away from the base of the vaporizer, h) said control means configured and operated to intermittently jet warm water toward the space beneath the vaporizer.

2. The apparatus of claim 1 wherein the base extends openly beneath the vaporizer.

3. The apparatus of claim 1 wherein the water jet pressure is at least about 50 p.s.i., and the water jet flow is at least 2 cubic inches/second/foot of width.

4. The apparatus of claim 3 wherein the vaporizer has stages of operation characterized in that operation of the vaporizer is discontinued during ice removal, and operation of the vaporizer is resumed at least about 15 minutes after operation of the water jetting device has been discontinued.

* * * * *